US006179213B1

(12) United States Patent
Gibino et al.

(10) Patent No.: US 6,179,213 B1
(45) Date of Patent: Jan. 30, 2001

(54) UNIVERSAL ACCESSORY FOR TIMING AND CYCLING HEAT, VENTILATION AND AIR CONDITIONING ENERGY CONSUMPTION AND DISTRIBUTION SYSTEMS

(75) Inventors: Dominick Gibino, Manassas, VA (US); Michael L. Simmons, Sarasota, FL (US)

(73) Assignee: Energy Rest, Inc., Manassas, VA (US)

( * ) Notice: Under 35 U.S.C. 154(b), the term of this patent shall be extended for 0 days.

(21) Appl. No.: 09/246,723

(22) Filed: Feb. 9, 1999

(51) Int. Cl.[7] ..... F24F 11/00; F23N 5/20
(52) U.S. Cl. ..... 236/46 R; 236/47; 165/238
(58) Field of Search ..... 236/46 R, 47; 165/238

(56) References Cited

U.S. PATENT DOCUMENTS 5,395,042 * 3/1995 Riley et al. ..... 236/46 R
5,462,225 * 10/1995 Massara et al. ..... 236/4 T
5,538,181 7/1996 Simmons et al. ..... 236/51

* cited by examiner

*Primary Examiner*—William Wayner
(74) *Attorney, Agent, or Firm*—Breiner & Breiner

(57) ABSTRACT

This invention provides a novel, inexpensive, universal energy control computing accessory module for altering at programmed times the operation of existing adjunct thermal/ventilation systems. In the module, interactive programming of control timing permits the accessory to be easily adapted for different types of adjunct installations to produce timed control signals particularly adapted for control of the particular installed system. One typical mode of operation is to turn on or off cyclically the thermal/ventilation system to run at a prescribed timing duty cycle. The invention may be used for diverse utility modes of operation, such as providing periodic ventilation controls for an unattended beach vacation home or for providing semi-automatic control of installed heating or air conditioning systems during occupancy of hotel rooms, dwellings, or stations within commercial buildings, as sensed by auxiliary detection means.

20 Claims, 3 Drawing Sheets

UNIVERSAL ACCESSORY FOR TIMING AND CYCLING HEAT, VENTILATION AND AIR CONDITIONING ENERGY CONSUMPTION AND DISTRIBUTION SYSTEMS

TECHNICAL FIELD

This invention relates to computer program control of thermal and ventilation conditions in heating, ventilation and air conditioning systems, and more particularly it relates to special purpose interactively programmable computers for controlling heating, ventilating and air conditioning systems.

BACKGROUND ART

There are no known prior art inexpensive special purpose computer systems that are universally adaptable to automatically dis-enable a variety of heating, air conditioning and ventilating (HVAC) systems under critical timing conditions. Specialty computers are limited to specific types of thermal/ventilation systems for special purpose individual tasks such as the saving of energy. If general purpose computers were to be programmed for control of different heating and ventilating systems, it would be impractical, inconvenient and expensive to have facilities and programming for the computers enabling them to operate with any specific thermal and ventilating control system or to establish specific utility benefits from any such thermal and ventilating control system.

Thus, it is an objective of this invention to introduce a low cost, user friendly, special purpose computerized system for timing control of the operation of thermal/ventilation systems.

There is known in the art a special purpose, low cost system for automatically turning off a thermal/ventilation control system in response to particular encountered conditions, namely: U.S. Pat. No. 5,538,181 to Michael L. Simmons, et al., Jul. 23, 1996 for Automatic Room Occupancy Controlled Fuel Saving System for Air Conditioning/Heater Units. This system however is limited to the special purpose of disabling an air conditioning system when a room is unoccupied.

DISCLOSURE OF THE INVENTION

This invention not only achieves the objective of providing an inexpensive, reliable and user friendly automated computer system for universal operation of different types of heating, ventilating and/or air conditioning systems (hereinafter termed thermal/ventilating systems), but also achieves the objective of providing universal operation for a wide range of heating system utility modes. As a matter of fact the computer control system afforded by this invention provides an easily installed substantially "plug-in" adjunct accessory to existing thermal/ventilating system installations.

To permit universality for the control of existing systems of various types without requiring expensive special software programming of the computer, the special purpose interactive programmable computer for controlling a thermal/ventilation system afforded by this invention includes basic general operational computer programming (22, FIG. 1) for said computer for automatically operating said system at specified times and over specified timing cycles as supplemented by auxiliary interactively controlled programming means (22, FIG. 1) for establishing specified operation time control conditions in said computer.

Thus, automatic timing controls are provided by this invention which universally serve to (a) establish the computer to condition the system for semi-automatically responding to internal or external trigger pulses such as occupancy sensors; (b) to establish prescribed on-off cycling periods of system operation; (c) to turn HVAC systems on or off as utility requirements demand; (d) to operate HVAC systems at prescribed duty cycles of operation; (e) to operate over long term or short term cycles depending upon utility conditions; etc.

Output computer control signals are provided by the operating computer system (22, FIG. 1) for universally controlling either the basic electric operating power of the thermal/ventilation system being controlled or such other conditions as the flow of thermal output air and fluids in different types of systems by means of solenoid actuated control systems to overrule or modify system operation, from a default or existing condition, typically established by a thermostatically controlled system.

The interactive programming feature provided by this invention involves a simple setting of a few control switches, without any necessary knowledge of the internal system logic or computer programming skills (22, FIG. 1). This interactive programming sub-system is integrated with and jointly establishes with internal computer programming (22, FIG. 1) to establish and assert a comprehensive set of different time control signals for achieving the universality objective of this invention.

This invention therefore relates to a novel energy control computing accessory adjunct to existing thermal/ventilation systems, which embody an interactively programmed timing control computer permitting the system to be easily adapted for a particular installation to produce timed control signals for control of the installed system. Other objects, features and advantages of the invention will be found throughout the following drawings, descriptions and claims.

BRIEF DESCRIPTION OF THE DRAWINGS

In the accompanying drawings, wherein like reference characters in the separate views indicate similar features to facilitate comparison.

THE PREFERRED EMBODIMENTS

Figure 1:
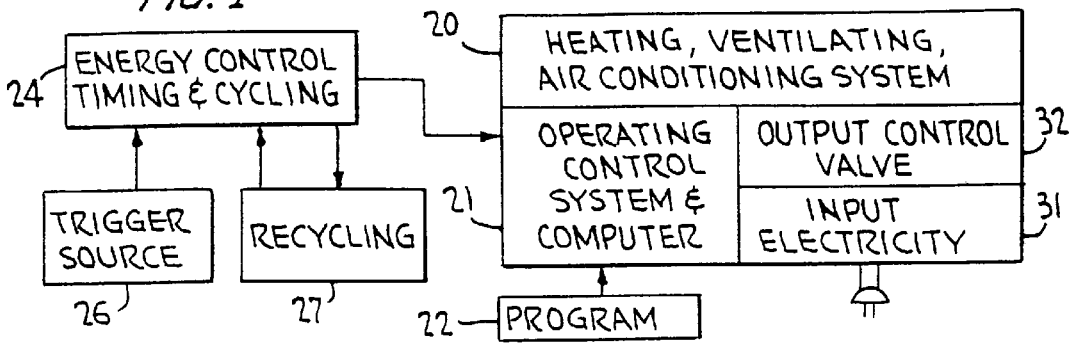
FIG. 1 is a block diagram system embodiment of the invention for controlling the activity of an installed thermal/ventilation system in response to a prescribed time cycle.

By reference to FIG. 1, it is seen that a heating, ventilating and/or air conditioning energy generation and distribution system (HVAC) 20, referred to hereinafter as a thermal/ventilation system, has a computerized operating control unit 21. This comprises a programmable computer, which is programmed (22) to provide timing and cycling choices of the nature hereinafter set forth, as exemplified by the energy control timing and cycling subsystem 24, which is interactively programmed (52) to meet the needs for a wide range of energy systems and associated utility modes of operation. The timing system 24 may be triggered from an outside trigger source 26, as for example, a room occupancy detector. Also the timing and cycling unit 24 provides for recycling (27) programmed time control agendas.

This invention thus provides an inexpensive universal accessory device for use with already installed and operable energy control thermal/ventilation systems 20, by way of producing output controls, typically the switching on or off of electrical input 31 for the HVAC system or the energy output 32 by the timing unit 24 by the operating computer control unit 21 as cooperatively programmed by the timing unit 24. The energy output control valve 32 thus can reduce or stop thermal fluid and air flow in appropriate HVAC systems. The timing and cycling unit 24 and associated operating control unit 21 interface and thereby cooperatively become a part of a comprehensive automated heating, cooling or ventilating system by either retrofit or integrated system design as a modular element in an original energy control system 20 at the time it is intially installed.

Figure 2:
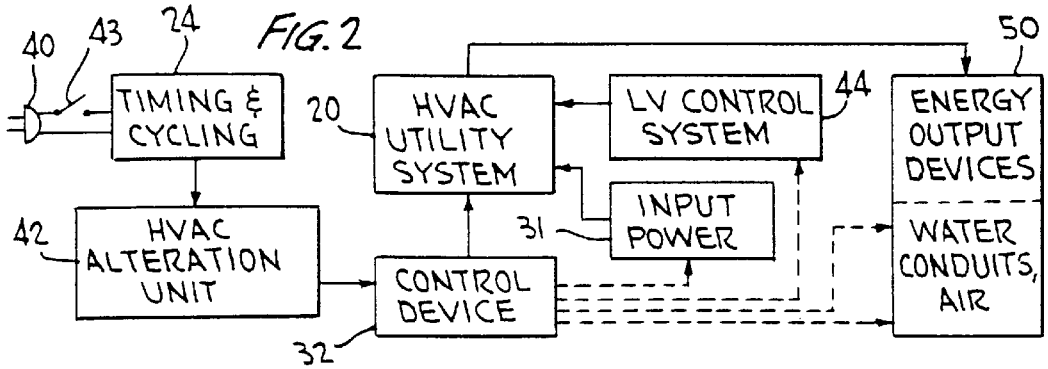
FIG. 2 is a block diagram system embodiment of the invention for universally controlling the output energy of different kinds of installed systems.

In FIG. 2 the operation of the accessory device in the control of the associated thermal/ventilation system is illustrated. The entire control system, including the timing unit 24, the HVAC alteration unit 42 and the HVAC utility system 20, is electrically powered from the high voltage source 40. Several types of energy control are illustrated, such as the simple opening and closing of the input power switch 43 to the HVAC utility system which by default setting is then turned off to an inactive status. Alternatively, the electrical control unit 31 may switch the low power electrical circuit 44, which may typically be a 20 volt line usually associated with a thermostatic control sub-system of the HVAC utility system 20. Where the IVAC system output is distributed by fluid or air flow conduits, 50 the control device 32 may be used to reduce or stop the conduit flow through appropriate solenoid controlled valves. Thus, the modular thermal/ventilation system control accessory provided by this invention may be universally employed with a variety of adjunct already installed system configurations 20.

Figure 3:
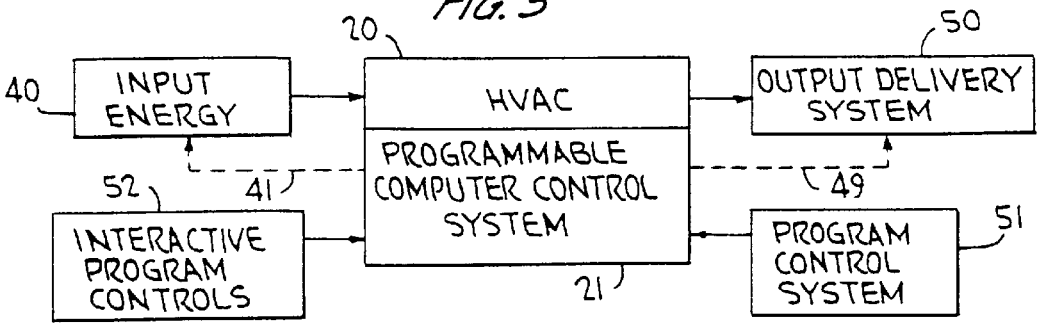
FIG. 3 is a block diagram system embodiment for interactively programming timing and control conditions in a pre-installed thermal/ventilation system with the adjunct computer timing and control accessory afforded by this invention.

FIG. 3 illustrates the operation of the programmable timing and control unit 21 in controlling either the input energy 40 via electrical control line 41 or the HVAC output delivery system 50 via the control line 49 typically a solenoid controlled device. The computerized programmable timing and control unit 21 typically employs a low cost micro-chip computer such as an 8-bit micro-controller part number PIC16C74. This programmable computer embodiment administers the timing control system for altering the thermal/ventilation system operation jointly in accordance with the automatic program controls of program control system 51, internally programmed at the factory, and the interactive program controls 52 provided for use in the field to meet the demand for a large range of utility objectives. These controls are treated in more detail hereinafter.

Figure 4:
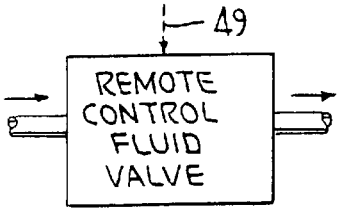
FIG. 4 is a block diagram of a fluid control valve operable to control the output energy of an installed heating-air conditioning system in accordance with this invention.
Figure 5:
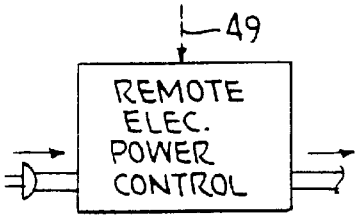
FIG. 5 is a block diagram of an energy control system configuration of the invention by way of electrical switching.
Figure 6:
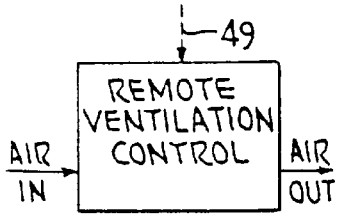
FIG. 6 is a block diagram of a solenoid actuated air flow control configuration of the invention.

FIGS. 4 to 6 respectively diagram the system control modes for fluid control, electrical system control and air flow control by way of solenoids and control valves operated by the accessory module afforded by this invention.

Figure 7:
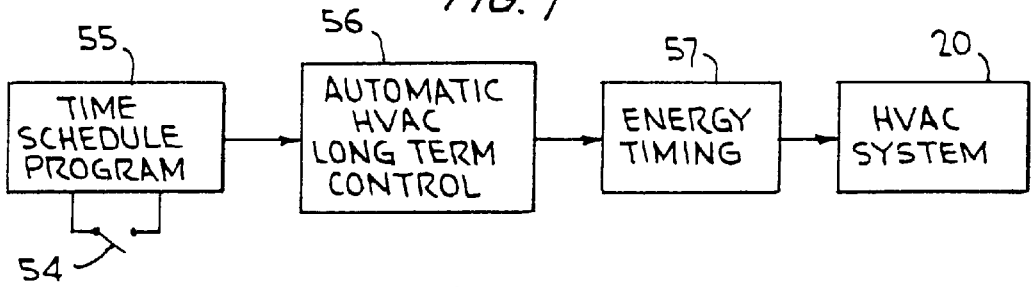
FIG. 7 is a block diagram representation of a typical utility system embodying the invention for long term control.

FIG. 7 illustrates a typical utility mode of operation of the HVAC system 20 with the universal special purpose interactive programmable computer accessory afforded by this invention. Assume that the HVAC system 20 is installed at a vacation property utility station that may be shut down and left idle for long time periods, such as over-winter. If idled in the summertime in a warm, humid climate such as in Florida, the HVAC unit should be used occasionally to ventilate and dry the premises and avoid mildew, for example. For any such long term program the interactively assisted time schedule program 55 provides a selected preferred mode of cycle timing, including the timer on-off switch 54 which is a programmed control device for optionally enabling the system by engaging the long term controls of 56 to cycle through its pre-programmed agenda for the energy timing schedule 57 thereby controlling the HVAC system 20. Such programs could typically be to turn on the HVAC system once a day for a—fifteen minutes on, twelve hours off, sixty minutes on—cycle during an extended vacancy to be shut off by the switch 54 upon re-occupancy to alter control of the HVAC system at the utility station.

Figure 8:
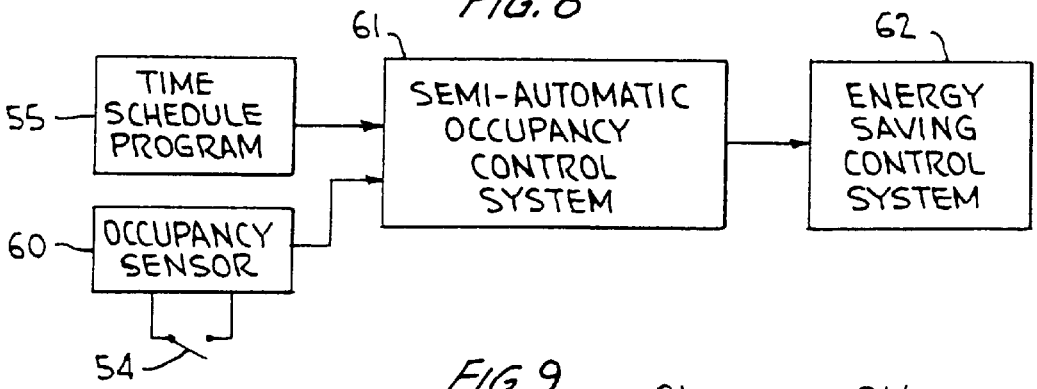
FIG. 8 is a block diagram representation of a further utility system embodying the invention for controlling output energy as a function of occupancy at an energy release station such as a hotel room.

Another and quite diverse utility station embodiment for this accessory, as illustrated in FIG. 8 is similar to the above mentioned U.S. Pat. No. 5,538,181 for reduction of the amount of energy expended by a HVAC system (62) in an unoccupied hotel room, while maintaining a residual comfort level that permits rapid rehabilitation for a new occupant. The present accessory control circuit similarly can set up cycling patterns with a pre-programmed duty cycle, such as fifteen minutes on and one hour off during unoccupancy periods. This present system provides a programmed trigger mode of operation control 60 located at the utility station so that some signal which could be as simple as an off-on switch 54, which is set by a bell-hop checking an occupant out of a hotel room utility station, or a housekeeper cleaning the room after occupancy. In this case the system is interactively programmed to result in a semi-automatic occupancy control system 61, subject to an occupancy trigger system 60, such as reversing switch 54 when a new occupant checks into the hotel room.

Figure 9:
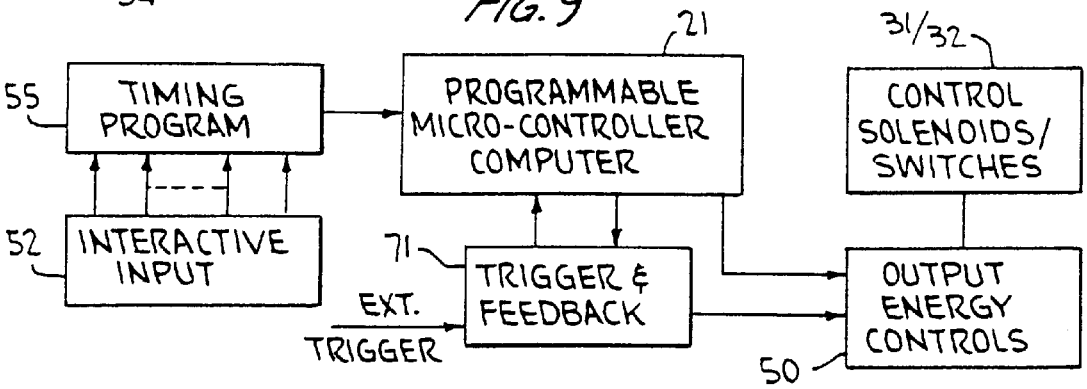
FIG. 9 is a block circuit diagram of the computer controlled interactively programmable accessory provided by this invention for controlling an adjunct pre-installed thermal/ventilation system.

FIG. 9 is a block circuit diagram of the special purpose programmable computerized accessory for controlling an adjunct thermal/ventilation system afforded by this invention. The interactive input 52 is necessary to make the accessory universally operable with a wide range of different HVAC systems and utility modes of operation thereof. The trigger and feedback feature 71, which may be interactively pre-programmed, permits a particular timing sequence pattern to be recycled independently from programming in the micro-controller 21 that cooperates with corresponding interactive inputs.

Figure 10:
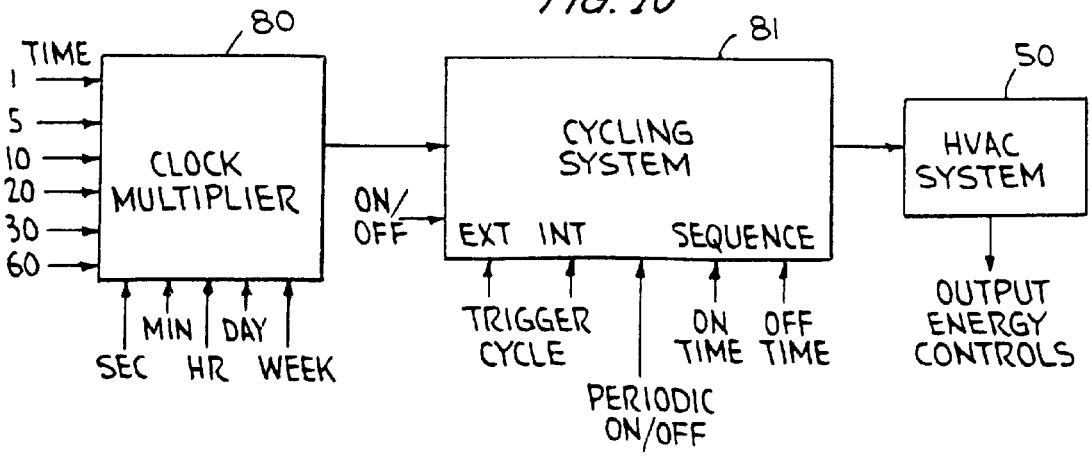
FIG. 10 is a block circuit diagram of an energy control accessory of this invention having a typical set of interactive programming controls for adapting the accessory for universal use in a variety of different thermal/ventilation systems.

FIG. 10 is a block circuit diagram of a typical interactively programmable timing and cycling control system, showing the simplicity of choices possible by simple interactively actuated switching connections. The clock/multiplier 80 permits a choice of basic time periods, typically 1, 5, 10, 24, 30, 60 and then multiplier factors taking effect, typically secs, minutes, hours, days, and weeks extending the timing controls optionally to operate not only with on-line real time activities but also with unmonitored long term activities. As indicated by the cycling system block 81, basically part of a pre-programmed control system of the computer sub-system, a range of options is illustrated, namely: triggered cycle-interior, triggered cycle-exterior, periodic on-off, sequencing with on and off timing, and system "on" control. Of course, other interactive programming switches may be involved but this is a representation of the simplicity and flexibility of the universal control system afforded by this invention, which permits for the first time in the art an inexpensive accessory to control a wide range of HVAC systems for a range of utility modes for saving energy and establishing timing patterns for automatically altering HVAC system operation.

Figure 11:
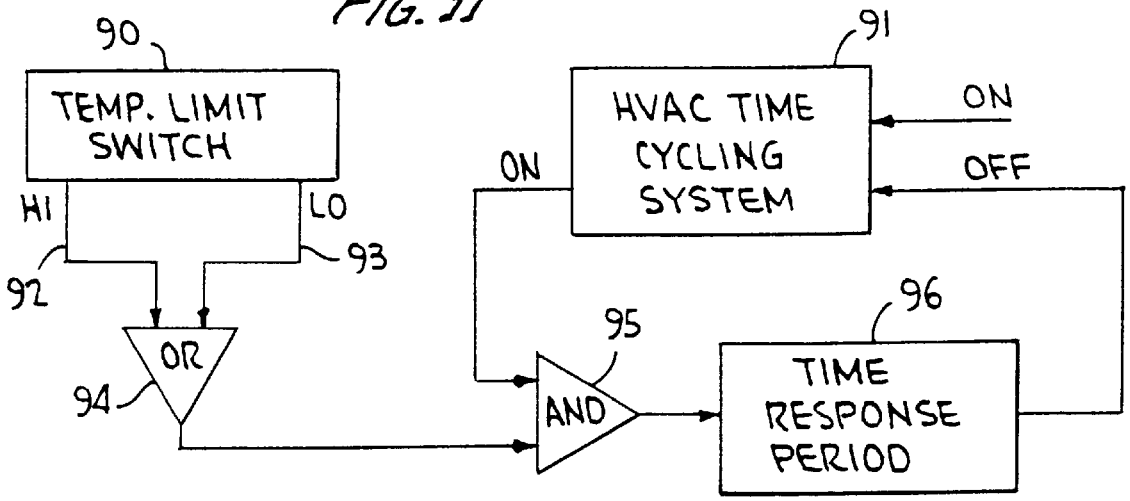
FIG. 11 is a block circuit diagram of safety override features which may be incorporated into the described embodiments.

Safety override features are shown in FIG. 11, which may be incorporated into the various embodiments previously described. Thus, the temperature switch 90 establishes temperature limits for overriding the time cycling system 91 for a predetermined period of times to return HVAC controls to a normal non-cycling thermostat control cycle.

Thus, for example, if the controlled area is unattended for long time periods in cold weather, the temperature switch can sense a temperature of 50° F. and restore normal thermostatic control with the time cycling system turned off for four hours. This would keep plumbing from freezing in wintertime for example. Alternatively HVAC operations power is conserved if a low temperature setting is incurred during summertime controls to lower temperature and/or humidity with the cycling system 91.

Similarly the cycling of air cooling systems could be inactivated in summertime when a moderate temperature is encountered in an unattended dwelling.

The basic override system of FIG. 11 thus provides a temperature sensing switch 90 operable at either low 92 or high 93 temperature settings for modifying operation of the time cycling HVAC system 91. The OR circuit 94 thus provides a signal at AND circuit 98, which in conjunction with an on signal from the cycling system 91 will set the timer 96 for a selected off time period, establishing normal default thermostatic control conditions.

Figure 12:
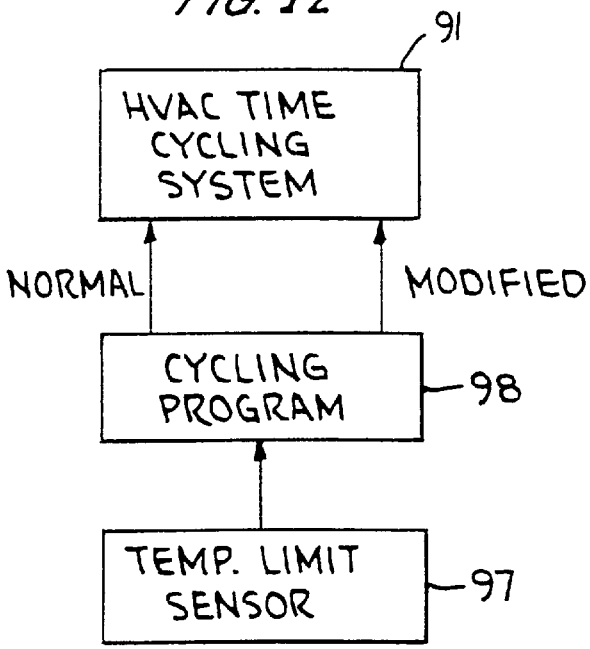
FIG. 12 is a block circuit diagram of an alternative temperature limit sensor control circuit useful in a safety override feature.

As seen in FIG. 12, an alternative temperature limit sensor control circuit 97 is shown which at block 98 changes the cycling system into an "emergency" or "modified" mode of cycling in a cycling pattern selected in the manner aforesaid.

Having thus advanced the state of the art, those novel features representative of the spirit and nature of this invention are defined with particularity in the following claims.

What is claimed is:

1. A special purpose interactive programmable computerized accessory for controlling flow of thermal output from an adjunct thermal/ventilation system, comprising in combination, a thermal/ventilation system control computer, computer programming means for said computer for automatically controlling flow of thermal output from said thermal/ventilation system at programmed times to modify operation of said system, auxiliary interactively controlled programming means jointly operable with said computer programming means for establishing specified operation time control conditions in said computer, and output computer control means controlled by said computer programming means for automatically controlling the flow of thermal output from said thermal/ventilation system, wherein said auxiliary programming means comprises an interactive programming sub-system adapted to produce output signals for universally controlling pre-existing thermal/ventilation systems in response to interactively selected operating conditions.

2. The computerized accessory defined in claim 1 further comprising: cycling control means administered by said auxiliary interactively controlled programming means for initiating a timing control cycle, and means operable to alter thermal output control of said system during said timing control cycle in response to an interactively selected trigger signal.

3. The computerized accessory defined in claim 1 further comprising:

an interconnected thermal control system including control instrumentation located at a utility station embodied in said thermal/ventilation system operable to alter control of the system at that station.

4. The computerized accessory defined in claim 1 further comprising:

a utility station operatively coupled to receive energy from said thermal/ventilation system, and feedback triggering means located at said utility station operatively coupling a triggering signal into said thermal/ventilation system for altering the thermal output of the thermal/ventilation system in response to local interactively operated controls at said utility station.

5. The computerized accessory defined in claim 1 further comprising:

automatic cycling means for cycling periodically said timing control conditions to reduce and increase the flow of thermal energy from said thermal/ventilating system.

6. The computerized accessory defined in claim 1 wherein the computer programming means for said computer further comprise an operational control program for automatically altering a thermal/ventilation system in response to a trigger signal at a specified facility resting in an inactive condition into an active utility mode of operation cycling periodically into a sequence of inactive and active conditions.

7. The computerized accessory defined in claim 1 wherein the computer programming means for said computer further comprise an operational control program for automatically altering at least a thermal/ventilation station in said thermal/ventilation system to pass from an active utility mode of operation into a conditional operational mode for inactivating the system in response to a predetermined trigger signal from a source exterior to said computer programs and auxiliary programming means.

8. The computerized accessory defined in claim 7 further comprising an occupancy control system, wherein said trigger signal indicates a condition of occupancy at said station, and the conditional operating mode inactivates the thermal/ventilation system into an inactive mode with a lower flow of thermal output from the thermal/ventilation system in the absence of occupancy.

9. The computerized accessory defined in claim 8 further comprising programming in said computer providing a cyclic sequence of activations and inactivations of the thermal/ventilation system with a predetermined duty cycle selected by said auxiliary interactively controlled programming means in response to interactive selections specified at said station.

10. The computerized accessory defined in claim 1 further comprising: a control valve solenoid operated by said output computer control means and adapted to control energy output from said thermal/ventilation system.

11. The computerized accessory defined in claim 10, wherein the solenoid is further adapted to control a fluid flow path.

12. The computerized accessory defined in claim 10 wherein the solenoid is further adapted to control an air flow path.

13. The computerized accessory defined in claim 10 wherein the solenoid is further adapted to interrupt a low voltage electrical connection link in the thermal/ventilation system.

14. The computerized accessory of claim 1 further comprising temperature limit switching means operable to modify said operation time control conditions in response to a predetermined temperature limit sensed by said auxiliary interactively controlled programming means.

15. The computerized accessory of claim 14 wherein the predetermined temperature limit is set to reduce energy flow from said thermal/ventilation system when summer temperature exceeds a predetermined limit to save energy.

16. The computerized accessory of claim 14 wherein the temperature limit is set for increasing energy flow from said thermal/ventilation system when winter temperature is lower than a predetermined limit to prevent freezing of plumbing in unoccupied premises.

17. A computer controlled thermal/ventilation system at an occupancy site for activating said system in a cyclically timed pattern of active-inactive transitions during periods of inactivity at the occupancy site, comprising in combination:

a computer control system with internal programming for producing a plurality of selectable operational cycles for said thermal/ventilation system, and interactively controlled programming means for creating jointly with said internal programming two different utility modes of operating the thermal/ventilation system on corresponding different prescribed duty cycles.

18. The system of claim 17 further comprising: a source of external trigger stimulation for selecting one of said utility modes in response to a predetermined condition at said occupancy site.

19. The system of claim 18 wherein the trigger stimulation further comprises an occupancy sensor.

20. The system of claim 18 further comprising a temperature limit switch to establish a predetermined flow of thermal output from said thermal/ventilation system.

* * * * *